US008128319B2

(12) United States Patent
Wissmann

(10) Patent No.: US 8,128,319 B2
(45) Date of Patent: Mar. 6, 2012

(54) SHIELDED TAMPER AND METHOD OF USE FOR MAKING AGGREGATE COLUMNS

(75) Inventor: Kord J. Wissmann, Mooresville, NC (US)

(73) Assignee: Geopier Foundation Company, Inc., Mooresville, NC (US)

( * ) Notice: Subject to any disclaimer, the term of this patent is extended or adjusted under 35 U.S.C. 154(b) by 214 days.

(21) Appl. No.: 12/511,310

(22) Filed: Jul. 29, 2009

(65) Prior Publication Data

US 2010/0028087 A1 Feb. 4, 2010

Related U.S. Application Data

(60) Provisional application No. 61/084,520, filed on Jul. 29, 2008.

(51) Int. Cl.
*E02D 3/02* (2006.01)

(52) U.S. Cl. ..... 405/271; 405/233

(58) Field of Classification Search ..... 405/232, 405/233, 237, 238, 271; 404/133.05, 133.1, 404/133.2

See application file for complete search history.

(56) References Cited

U.S. PATENT DOCUMENTS

| | | | |
|---|---|---|---|
| 779,880 | A | 1/1905 | Shuman |
| 947,548 | A | 1/1910 | Lind |
| 1,657,727 | A | 1/1928 | Stubbs |
| 1,764,948 | A | 6/1930 | Frankignoul |
| 1,955,101 | A | 4/1934 | Sloan |
| 2,036,355 | A | 4/1936 | Orr et al. |
| 2,109,933 | A | 3/1938 | Sloan |
| 2,181,375 | A | 11/1939 | Leistner |
| 2,223,024 | A | 11/1940 | Belerlein |
| 2,224,506 | A | 12/1940 | Baily |
| 2,248,247 | A | 7/1941 | Nichols |
| 2,255,342 | A | 9/1941 | Baily |
| 2,255,343 | A | 9/1941 | Baily |
| 2,289,248 | A | 7/1942 | Davis |
| 2,437,043 | A | 3/1948 | Riemenschneider et al. |
| 2,659,281 | A | 11/1953 | Lucas |
| 2,894,435 | A | 7/1959 | Brown |
| 2,917,979 | A | 12/1959 | Dening et al. |
| 2,938,438 | A | 5/1960 | Hamilton |
| 2,951,427 | A | 9/1960 | Moir |
| 3,027,724 | A | 4/1962 | Smith |
| 3,073,124 | A | 1/1963 | Nadal |

(Continued)

FOREIGN PATENT DOCUMENTS

CA 2641408 A1 4/2009

(Continued)

OTHER PUBLICATIONS

Roger Bullivant "RB Vibro Displacement", Nov. 2001.

*Primary Examiner* — David Bagnell
*Assistant Examiner* — Benjamin Fiorello
(74) *Attorney, Agent, or Firm* — Ward and Smith, P.A.

(57) ABSTRACT

A tamper device includes a shaft for driving a tamper head. A tamper head is attached to the end of the shaft for tamping a lift of aggregate in a cavity formed in a ground surface. A shield extends upwardly a predetermined height from the tamper head an amount sufficient to prevent sidewalls of the cavity from failing and collapsing. Methods of constructing aggregate columns with thicker lifts are also disclosed.

26 Claims, 7 Drawing Sheets

U.S. PATENT DOCUMENTS

| | | | |
|---|---|---|---|
| 3,112,016 | A | 11/1963 | Peterson |
| 3,199,424 | A | 8/1965 | Glass |
| 3,206,935 | A | 9/1965 | Phares |
| 3,232,188 | A | 2/1966 | Frohnauer |
| 3,236,164 | A | 2/1966 | Miller |
| 3,246,584 | A | 4/1966 | Lee |
| 3,256,790 | A | 6/1966 | Hoppenrath |
| 3,274,908 | A | 9/1966 | Grant et al. |
| 3,279,338 | A | 10/1966 | Briggs et al. |
| 3,314,341 | A | 4/1967 | Schulin |
| 3,316,722 | A | 5/1967 | Gibbons et al. |
| 3,327,483 | A | 6/1967 | Gibbons |
| 3,344,611 | A | 10/1967 | Philo |
| 3,363,523 | A | 1/1968 | Brock et al. |
| 3,638,433 | A | 2/1972 | Sherard |
| 3,685,302 | A | 8/1972 | Fuller |
| 3,782,845 | A | 1/1974 | Briggs et al. |
| 3,909,149 | A | 9/1975 | Century |
| 4,091,661 | A | 5/1978 | Handy et al. |
| 4,113,403 | A | 9/1978 | Tertinek et al. |
| 4,314,615 | A | 2/1982 | Sodder, Jr. et al. |
| 4,388,018 | A | 6/1983 | Boschung |
| 4,553,606 | A | 11/1985 | Arnold |
| 4,605,339 | A | 8/1986 | Bullivant |
| 4,708,529 | A | 11/1987 | Lindell |
| 4,730,954 | A | 3/1988 | Sliwinski et al. |
| 4,750,566 | A | 6/1988 | Lindstrom |
| 4,770,256 | A | 9/1988 | Lipsker et al. |
| 5,145,285 | A | 9/1992 | Fox et al. |
| 5,249,892 | A | 10/1993 | Fox et al. |
| RE35,073 | E | 10/1995 | Dickey et al. |
| 5,608,169 | A | 3/1997 | Fujioka et al. |
| 5,622,453 | A | 4/1997 | Finley et al. |
| 5,797,705 | A | 8/1998 | Kellner |
| 5,857,803 | A | 1/1999 | Davis et al. |
| 5,978,749 | A | 11/1999 | Likins, Jr. et al. |
| 6,139,218 | A | 10/2000 | Cochran |
| 6,234,718 | B1 | 5/2001 | Moffitt et al. |
| 6,354,766 | B1 | 3/2002 | Fox |
| 6,354,768 | B1 | 3/2002 | Fox |
| 6,425,713 | B2 | 7/2002 | Fox et al. |
| 7,073,980 | B2 | 7/2006 | Merjan et al. |
| 2006/0088388 | A1* | 4/2006 | Wissmann et al. ..... 405/232 |
| 2007/0077128 | A1 | 4/2007 | Wissmann |

FOREIGN PATENT DOCUMENTS

| | | | |
|---|---|---|---|
| DE | 1036891 | B | 8/1958 |
| DE | 1100920 | B | 3/1961 |
| DE | 1105597 | B | 4/1961 |
| DE | 1276319 | B | 8/1968 |
| EP | 0703320 | A2 | 3/1996 |
| EP | 1234916 | A2 | 8/2002 |
| EP | 1498550 | A2 | 1/2005 |
| FR | 616470 | | 5/1926 |
| FR | 917965 | A | 1/1947 |
| GB | 369816 | A | 3/1932 |
| GB | 0603972 | A | 6/1948 |
| GB | 2286613 | A | 8/1995 |
| GB | 2455627 | A | 6/2009 |
| JP | 56-003714 | A | 1/1981 |

* cited by examiner

SHIELDED TAMPER AND METHOD OF USE FOR MAKING AGGREGATE COLUMNS

CROSS REFERENCE TO RELATED APPLICATIONS

This application is related to and claims the priority of U.S. Provisional Patent Application Ser. No. 61/084,520, filed Jul. 29, 2008; the disclosure of which is incorporated by reference in its entirety.

FIELD OF THE INVENTION

The invention relates to a tamper head and a method of installing an aggregate column in soft or unstable soil environments. More particularly, the invention relates to such a tamper head and method effective to prevent sidewall soil failure during tamping while allowing for thicker lifts of aggregate to be used.

BACKGROUND OF INVENTION

Heavy or settlement-sensitive facilities that are located in areas containing soft or weak soils are often supported on deep foundations, consisting of driven piles or drilled concrete columns. The deep foundations are designed to transfer the structure loads through the soft soils to more competent soil strata.

In recent years, aggregate columns have been increasingly used to support structures located in areas containing soft soils. The columns are designed to reinforce and strengthen the soft layer and minimize resulting settlements. The columns are constructed using a variety of methods including the drilling and tamping method described in U.S. Pat. Nos. 5,249,892 and 6,354,766; the driven mandrel method described in U.S. Pat. No. 6,425,713; the tamper head driven mandrel method described in U.S. Pat. No. 7,226,246; and the driven tapered mandrel method described in U.S. Pat. No. 7,326,004; the disclosures of which are incorporated by reference in their entirety.

The short aggregate column method (U.S. Pat. Nos. 5,249,892 and 6,354,766), which includes drilling or excavating a cavity, is an effective foundation solution when installed in cohesive soils where the sidewall stability of the hole is easily maintained. The method generally consists of: a) drilling a generally cylindrical cavity or hole in the foundation soil (typically around 30 inches); b) compacting the soil at the bottom of the cavity; c) installing a relatively thin lift of aggregate into the cavity (typically around 12-18 inches); d) tamping the aggregate lift with a specially designed beveled tamper head; and e) repeating the process to form an aggregate column generally extending to the ground surface. Fundamental to the process is the application of sufficient energy to the beveled tamper head such that the process builds up lateral stresses within the matrix soil up along the sides of the cavity during the sequential tamping. This lateral stress build up is important because it decreases the compressibility of the matrix soils and allows applied loads to be efficiently transferred to the matrix soils during column loading.

The tamper head driven mandrel method (U.S. Pat. No. 7,226,246) is a displacement form of the short aggregate column method. This method generally consists of driving a hollow pipe (mandrel) into the ground without the need for drilling. The pipe is fitted with a tamper head at the bottom which has a greater diameter than the pipe and which has a flat bottom and beveled sides. The mandrel is driven to the design bottom of column elevation, filled with aggregate and then lifted, allowing the aggregate to flow out of the pipe and into the cavity created by withdrawing the mandrel. The tamper head is then driven back down into the aggregate to compact the aggregate. The flat bottom shape of the tamper head compacts the aggregate; the beveled sides force the aggregate into the sidewalls of the hole thereby increasing the lateral stresses in the surrounding ground.

The driven tapered mandrel method (U.S. Pat. No. 7,326,004) is another means of creating an aggregate column with a displacement mandrel. In this case, the shape of the mandrel is a truncated cone, larger at the top than at the bottom, with a taper angle of about 1 to about 5 degrees from vertical. The mandrel is driven into the ground, causing the matrix soil to displace downwardly and laterally during driving. After reaching the design bottom of the column elevation, the mandrel is withdrawn, leaving a cone shaped cavity in the ground. The conical shape of the mandrel allows for temporarily stabilizing of the sidewalls of the hole such that aggregate may be introduced into the cavity from the ground surface. After placing a lift of aggregate, the mandrel is re-driven downward into the aggregate to compact the aggregate and force it sideways into the sidewalls of the hole. Sometimes, a larger mandrel is used to compact the aggregate near the top of the column.

One long-standing problem that has been sought to be solved is that in soft or unstable soil environments, a formed column cavity may tend to distort, cave-in, or become otherwise damaged as the column is formed in situ. The sidewall collapse occurs as the prior art tamper is driven downward thereby applying lateral pressure to the side of the cavity as the aggregate is compressed. This pressure results in a rotation of the soft soils in the vicinity around the tamper head and results in sidewall collapse above the elevation of the tamper head. Sidewall collapse must be removed during the construction process and can lead to a loss of pre-stressing. The problem is particularly vexing for relatively thick compacted lifts. Furthermore, this soil failure can slow the column construction process as extra soil must be removed or the cavity otherwise re-opened. It is therefore desirable to provide for an aggregate column construction technique which reduces the potential for damage to the column cavity (including sidewall collapse) during column construction. It is also desirable to provide for an aggregate column construction technique which allows for larger thicknesses of aggregate to be compacted per lift, thereby increasing efficiency of the process and limiting the amount of time the driven mandrel must be present in the cavity.

BRIEF DESCRIPTION OF INVENTION

In one aspect, the invention relates to a tamper device including a shaft, a driven tamper head, and a shield. The tamper head is attached at the end of the shaft for tamping a lift of aggregate in a cavity formed in the ground. The shield extends upwardly a predetermined height from said tamper head an amount sufficient to prevent sidewalls of a cavity in which the tamper device is used from failing and collapsing into the cavity.

The tamper head may further comprise a tapered surface extending circumferentially from said bottom face to an edge thereof. The tapered surface may extend upwardly from the blunt bottom face at an angle of about 45 degrees.

The shield may be of a width wherein it is in abutment at a bottom edge thereof with the tamper head at a top surface about an edge thereof. The shield may rest on the tamper head and may have an opening for allowing passage of said shaft having said tamper head attached thereto. The predetermined height of the shield may be in the range of about 3 to 5 feet. The width of the tamper may be in the range of about 12 to 36 inches. The tamper head may be shaped substantially circular.

In an alternative aspect, the invention relates to a method of constructing aggregate columns. The method includes forming an elongate cavity in a ground surface. The cavity has a generally uniform cross-sectional area. A lift of aggregate is placed in the cavity. The lift is then tamped with a tamper device having a tamper head attached at the end of a shaft. The tamper head has a generally flat, blunt bottom face and has a shield extending upwardly a predetermined height from the tamper head an amount sufficient to prevent sidewalls of the cavity from failing and collapsing into the cavity. The method is conducted preferentially in soft ground. More particularly, such soft ground may be silty clay, sandy clay, lean to fat clay, sandy lean clay or soft clay, in some cases with groundwater.

The tamper head used in the method may comprise a tapered surface extending circumferentially from said bottom face to an edge thereof The tapered surface may extend upwardly from the blunt bottom face at an angle of about 45 degrees.

The shield used in the method may be of a width wherein it is in abutment at a bottom edge thereof with the tamper head at a top surface about an edge thereof. The shield may rest on the tamper head and may have an opening for allowing passage of said shaft having said tamper head attached thereto.

The tamping in the method may be conducted by driving the tamper head with said shaft extending upwardly therefrom, said shield extending upwardly a predetermined height sufficient to prevent said side walls of the elongate cavity from failing and collapsing into the cavity during tamping operations, and said shield having an opening at the top allowing said shaft to pass therethrough to connect to said tamper head.

The predetermined height of the shield used in the method may be in the range of about 3 to 5 feet. The width of the tamper head may be in the range of about 12 to 36 inches. The tamper head may be shaped substantially circular.

The thickness of the lift of aggregate in the method may be approximately equal to two to three times the distance across the cavity. The tamping may be conducted in a cavity formed in soft soil.

DETAILED DESCRIPTION OF THE INVENTION

The present invention is directed to the installation of aggregate columns in foundation soils for the support of buildings, walls, industrial facilities, and transportation-related structures. In particular, the invention is directed to the efficient installation of aggregate columns through the use of an improved tamper head incorporating a novel shield portion. The shielded tamper is designed to allow for a quicker and more efficient column construction process by preventing sidewall soil failure during tamping. Further, the tamper device or shielded tamper contemplated herein allows for thicker lifts of aggregate to be used than can be used in conventional aggregate column construction processes.

Figure 1A:
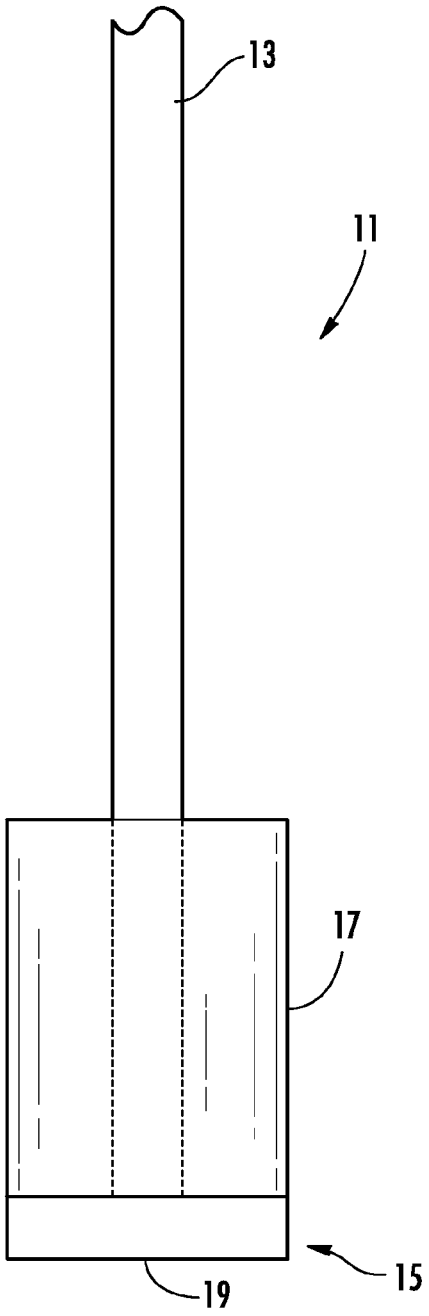
FIGS. 1A and 1B are side views of the tamper device of the invention.
Figure 1B:
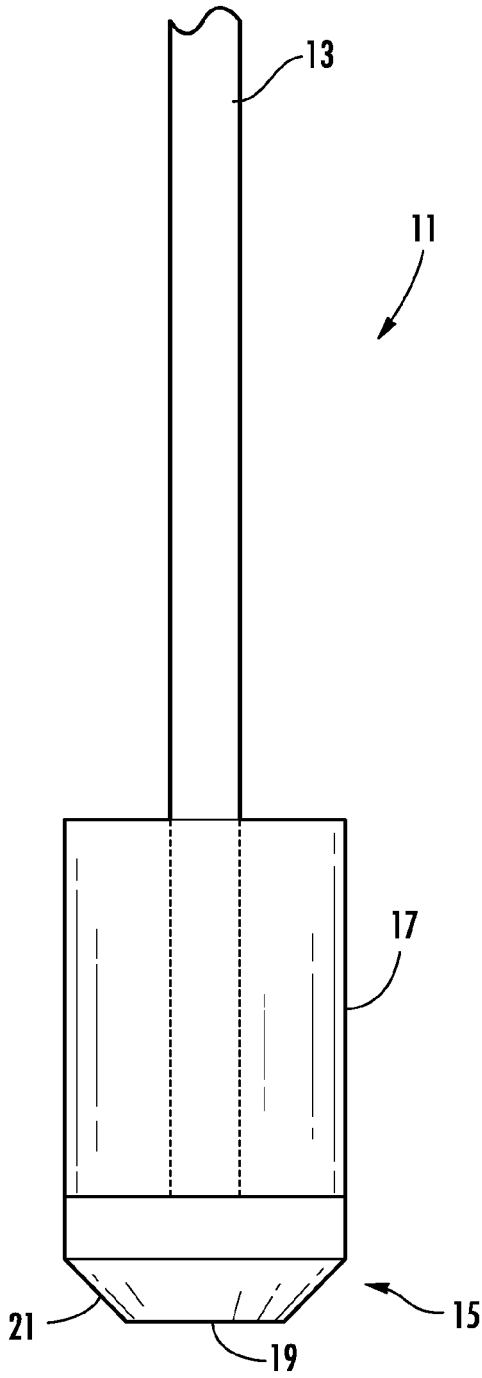

Throughout this document, the tamper device 11 of the present invention contemplated herein may be referred to as a "shielded tamper" device or tool as shown in FIGS. 1A and 1B. The tamper device 11 can comprise a shaft 13 for driving a tamper head 15 attached at the end of the shaft 13 for tamping a lift of aggregate 47 (FIGS. 3-5) in a cavity 41 formed in a ground surface. A shield 17 extends upwardly a predetermined height from the tamper head 15 an amount sufficient to support the sidewalls 51 of the cavity 41 in which the tamper device 11 is used, and to prevent the sidewalls 51 from failing and collapsing into the cavity 41.

The tamper head 15 can have a generally flat, blunt bottom face 19 (FIG. 1A) and optionally a tapered surface 21 extending circumferentially from the bottom face 19 to an edge thereof (FIG. 1B). In one embodiment, the tapered surface 21 extends upwardly from the blunt bottom face 19 at an angle of about 45 degrees. The shield 17, which can be made of metal, plastic, rubber, or other materials, can be of a width that is generally similar to the width of the tamper head 15. Generally, the shield 17 is configured closely to the tamper head 15 to prevent the intrusion of soil between the tamper head 15 and the shield 17.

In one embodiment, the shield 17 has a height above the top surface of the tamper head 15 of around 3 feet. In a more general aspect, the height of the shield 17 is selected to be effective to prevent sidewall collapse as will be readily apparent from the disclosure herein. The width of the tamper head 15 (and thus the shield) may be about 12 to 30 inches and the tamper head 15 can be substantially circular. More generally, the width is selected to be effective to achieve desired tamping while preventing sidewall collapse.

The shield is preferably a lightweight structure. Exemplary embodiments of the shield 17 may consist of a hollow steel or firm plastic cylinder (with or without internal cross-bracing), a steel or firm plastic cylinder filled with lightweight foam, or firm synthetic belting wrapped around the shaft 13.

Figure 2:
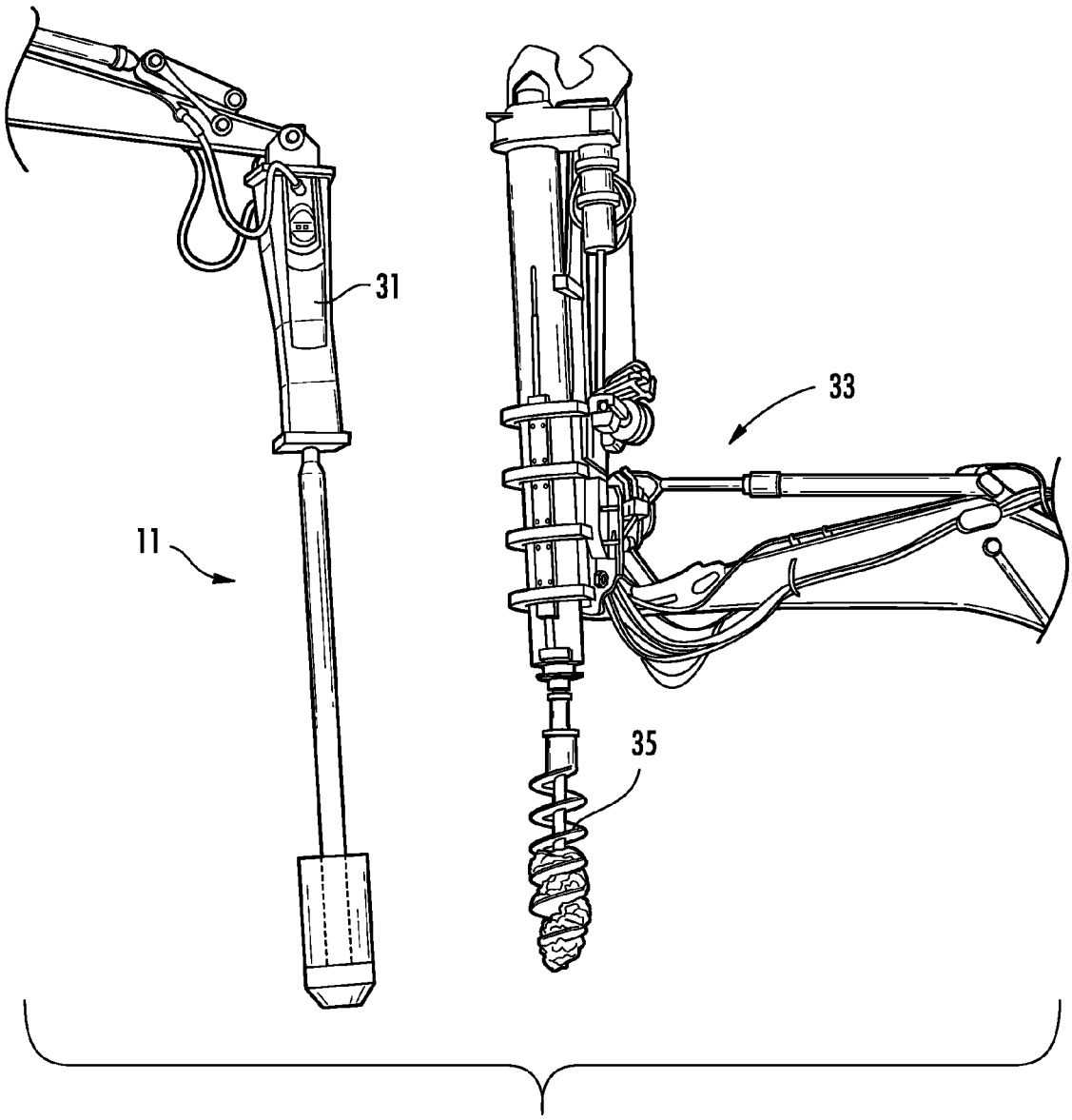
FIG. 2 illustrates a drill/auger and an impact device, including the tamper device of the invention.
Figure 3:
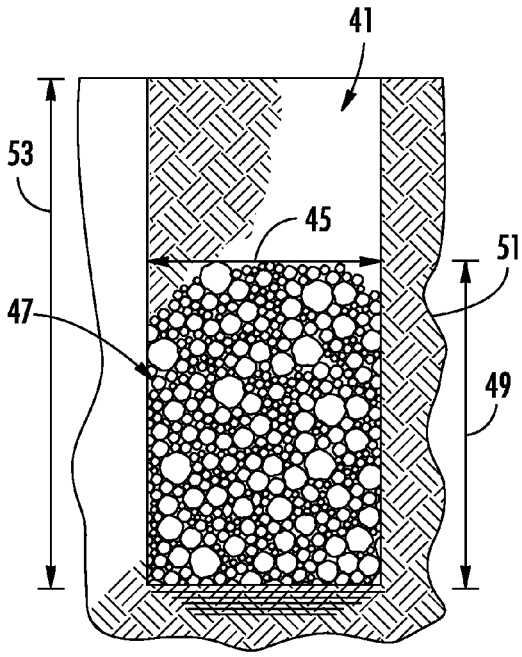
FIG. 3 is a side partial cross-section view illustrating how aggregate fill is added as lifts into a cavity prepared for use with the invention.

Referring to FIGS. 2-5, a method of use is also contemplated. The method includes forming an elongate vertical cavity 41 or hole having a generally uniform cross-sectional area of a width 45, as shown in FIG. 3, in a ground surface. The hole or cavity 41 may be made with a drilling device 33 as shown in FIG. 2. The drilling device 33 has a drill head or auger 35 to form the hole or cavity 41. The tamper device or tool 11 is then driven into the cavity 41 to compress aggregate 47 by an impact or driving device 31. Preferably, the vertical cavity 41 is generally cylindrical and is formed in any suitable way, and optionally by the drilling device as shown in FIG. 2. The cavity 41, which is of predetermined depth 53 can also be formed by penetrating and extracting an elongated tube or mandrel.

Figure 4:
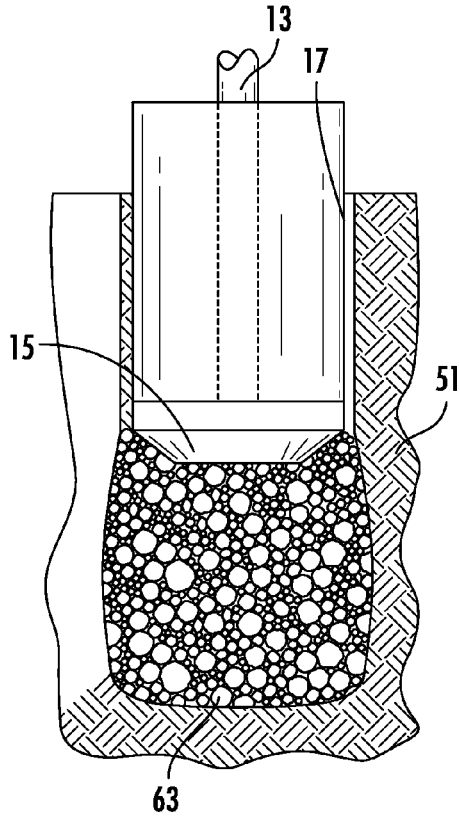
FIG. 4 is a side partial cross-section view illustrating tamping of the aggregate fill with the tamper device of the invention.

As shown in FIG. 3, a lift of aggregate 47 is then placed into the bottom of the cavity 41 at a predetermined lift thickness 49. Because of the configuration of the shielded tamper tool 11 of the present invention, each lift of aggregate placed into the cavity can have a thickness in the cavity greater than lift thicknesses possible with conventional aggregate column formation techniques. For example, as discussed below, uncompacted lifts of aggregate 47 in the range of 3 to 5 feet in cavities with diameters of 20 to 24 inches diameter are possible. This aspect allows the process to be more efficient because conventional aggregate column methods typically use 1.5 foot thick uncompacted lifts of aggregate, requiring more lifts and more time to build the column, whereas the tamper tool 11 contemplated herein can compact lifts 47 two times and more as thick as conventional tools. The aggregate lift 47 is then tamped as shown in FIG. 4 with the shielded tamper tool 11 of the present invention, which is especially designed to address the long-felt need of preventing the sidewalls 51 of the cavity 41 from failing and collapsing into the cavity 41 during the tamping process. As discussed above, this sidewall collapse has been prevalent in soft or unstable soil environments when prior art tamper devices have been driven downward thereby applying lateral pressure to the side of the cavity as the aggregate is compressed and causing the rotated soft soil in the vicinity around the tamper head to collapse above the elevation of the tamper head.

Figure 5:
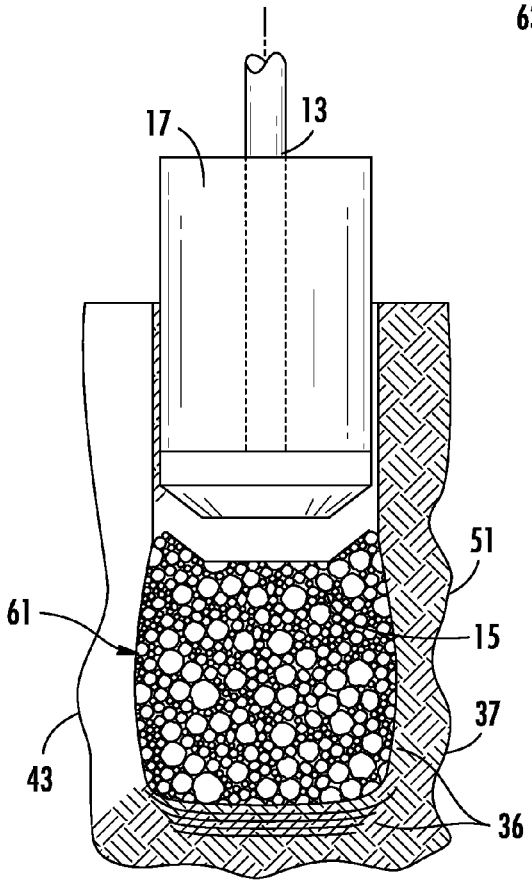
FIG. 5 is a side partial cross-section view illustrating the aggregate fill after tamping.

The column is completed with the addition and tamping of successive lifts. FIG. 5 illustrates a compacted lift 61 of predetermined depth after compacting, and lateral expansion to penetrate the sidewall 51 at regions 37 and 43 of the cavity 41. The soil surrounding the compacted lift 61 is also densified as a result, at region 36.

For use with the preferred embodiments as described herein and illustrated, a suitable aggregate 63 consists of "well graded" highway base course aggregate with a maximum particle size of 2 inches and less than 12% passing the No. 200 sieve size (0.074 inches). Alternate aggregates may also be used such as clean stone, maximum particles sizes ranging up to about 3 inches, aggregates with less than 5% passing the No. 200 sieve size, recycled concrete, slag, sand, recycled asphalt, cement treated base and other construction materials. The maximum size of the aggregate should not exceed 25% of the diameter of the cavity.

A primary advantage of the present invention is that the shielded tamper solves the problem found with use of conventional aggregate column formation techniques of soil failure and collapsing into the formed cavity. Therefore, the present invention is more efficient at building up lateral earth pressure during construction than are the tamper heads described in the prior art. Another advantage is that the shielded tamper of the present invention can be applied to thicker lifts of aggregate than could be used in the prior art. For the preferred embodiment, this means that the tamper head can be applied to 3 to 5-foot thick lifts of loosely placed aggregate. In practice, this means that columns with the same or greater support capacity may now be constructed with thicker lift heights.

Exemplary operation and testing will now be described with reference to the following Examples.

EXAMPLE I

Figure 6:
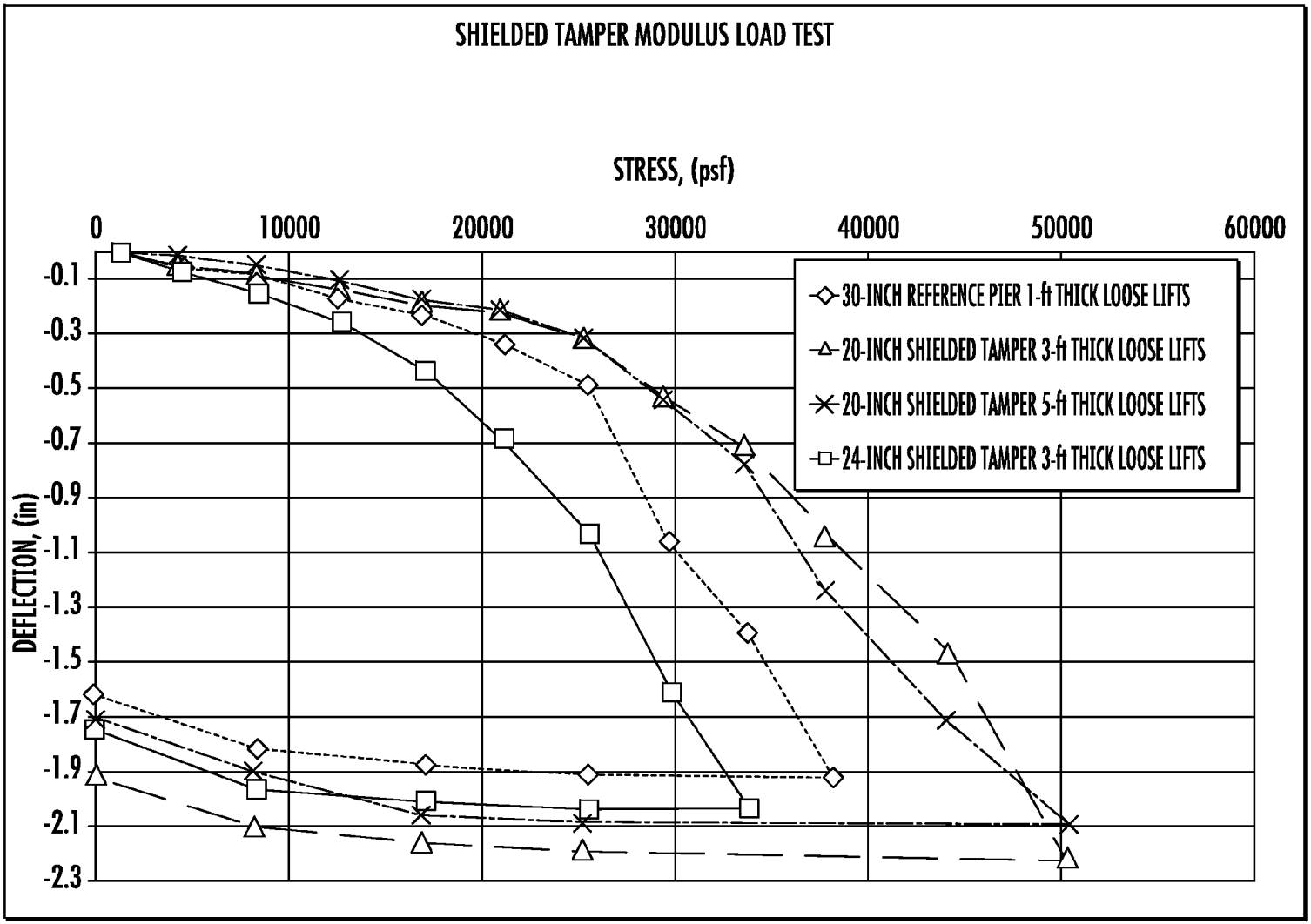
FIG. 6 is a table illustrating the results of load tests on an aggregate column assembled using the tamper device of the invention as in Example I.

FIG. 6 illustrates the advantages described previously resulting from load tests conducted on columns constructed using a conventional process and using the present invention as will be discussed hereafter. The shielded tamper 11 used in the tests consisted essentially of that described above and shown in the attached Figures. In this example, the shielded tamper 11 was a 5-foot long, 18-inch diameter shield cylinder fitted on top of a beveled tamper head 15. The shield 17 was welded to the tamper head 15. A beveled perimeter 21 of the surface was tapered down at 45 degrees, from the upper end of the tamper head to a flat bottom surface.

For this testing, holes were drilled to a depth of 12 feet prior to backfilling with 1-inch minus crushed limestone. On the first day of testing, an 18-inch diameter hole was initially drilled, but it was determined that a hole with a diameter slightly larger than the shield cylinder would be preferable. As such, "cutters" were added to each side of an auger 35 used to increase the diameter of the hole to 20 inches. Penetration of the shielded tamper tool 11 was more efficient with the larger hole.

The remainder of the first day was spent varying the compaction time (typically 20, 30, and 45 seconds per lift) and lift thicknesses (3 and 5 feet). With 5-foot lift thicknesses compaction of 1 to 1.5 feet per lift was typical resulting in compacted lift thicknesses of 3.5 to 4 feet. For 3-foot lift thicknesses, compaction of 0.75 to 1 foot was typical resulting in compacted lift thicknesses of 2 to 2.25 feet. At these compaction times and lift thicknesses, Bottom Stabilization Tests ("BSTs") yielded 1 to 2 inches of deflection over 10 seconds. One dynamic core penetration ("DCP") test required 30 blows for ¾ inch penetration, indicating that the top surface of the lift was sufficiently compacted.

On the second day of testing, four columns were installed, including a 20-inch hole diameter with 5-foot thick loose lifts, a 20-inch hole diameter with 3-foot thick loose lifts, a 24-inch hole diameter with 3-foot thick loose lifts, and a 30-inch hole diameter with 1-foot thick loose. The first three columns were compacted with the shielded tamper tool 11 of the present invention as described above (i.e., 5-foot long, 18-inch diameter shield cylinder fitted with a beveled tamper head). The fourth column was compacted with a standard conventional tamper head. Since the 20-inch diameter auger 35 had to be modified from an 18-inch diameter auger, and there was a standard 24-inch diameter auger on site, the 24-inch diameter drilled column was also constructed using the tamper head of the present invention and tested. The standard conventional 30-inch diameter column was used as a reference for the shielded tamper columns.

For the 20-inch diameter column with 5-foot loose lifts and 45-second tamping time, 1.1 to 1.4 feet of compaction was measured per lift. A BST on the lower lift resulted in 1¼ inches deflection. A DCP test on the upper lift yielded ½ inch for 25 blows.

For the 20-inch diameter column with 3-foot loose lifts and 30-second tamping time, 0.9 to 1.1 feet of compaction was measured per lift. A BST on the first and second lifts resulted in 1 inch and ½ inch deflection, respectively. A DCP on the upper lift yielded ⅜ inch for 25 blows.

For the 24-inch diameter column with 3-foot loose lifts and 30-second tamping time, 1.0 to 1.4 feet of compaction was measured per lift. A BST on the first and second lifts resulted in 1½ inches and 1 inch deflection, respectively. A DCP test on the upper lift yielded ¾ inch for 25 blows.

For the 30-inch diameter column with 1-foot loose lifts and 20-second tamping time, 0.5 feet of compaction was consistently measured per lift. A BST on the second and third lifts resulted in ⅜ inch and ¼ inch deflection, respectively. A DCP test on the upper lift yielded ¾ inch for 25 blows.

A plot showing the modulus curves for all four tests is shown in FIG. 6. At a top of pier deflection of 0.5 inches, the 30-inch diameter reference column was loaded at a stress of 26,000 psf. At this same deflection criterion, top of pier stress of 18,000 psf, 29,000 psf, and 29,000 psf, was achieved for the shielded tamper piers constructed within the 24-inch and each of the 20-inch diameter holes, respectively.

In summary, the shielded tamper system 11 constructed within 20-inch diameter holes using 3 and 5-foot lifts provided superior results to the reference column despite the increased lift thicknesses. For the 24-inch diameter drilled hole compacted with the 18-inch diameter shielded tamper, the results of the load test show inferior results compared to the reference pier. As such, the tamper diameter to hole diameter ratio is critical in achieving a high modulus, as evidenced by the 24-inch diameter hole compacted with an 18-inch diameter shielded tamper, which achieved the lowest modulus of the four combinations tested. Accordingly, it would be preferable for the diameter of the tamper (and shielded portion) to be slightly less than the diameter of the drilled hole.

EXAMPLE II

As another example, the system of the invention was used to install columns at a Jackson Madison County Hospital site in Jackson, Tenn. Three columns were tested for this project: one with 1.5-foot thick loose lifts and 15-second tamping time per lift, one with 3.0-foot thick loose lifts and 20-second tamping time per lift, and one with 3.0-foot thick loose lifts and 30-second tamping time per lift. All three of the columns were installed with shaft lengths of 12 feet.

The subsurface conditions consisted of silty clay transitioning into sandy clay at a depth of about 7 feet, over clayey sand at approximately 10 feet, over sand at about 15 feet. SPT N-values ranged from 3 to 10 in the silty clay, increasing with depth; 11 in the sandy clay; 27 in the clayey sand; and 20 to refusal in the sand, again increasing with depth.

A 22-inch diameter shielded tamper head was used within a 24-inch diameter drilled hole.

Figure 7:
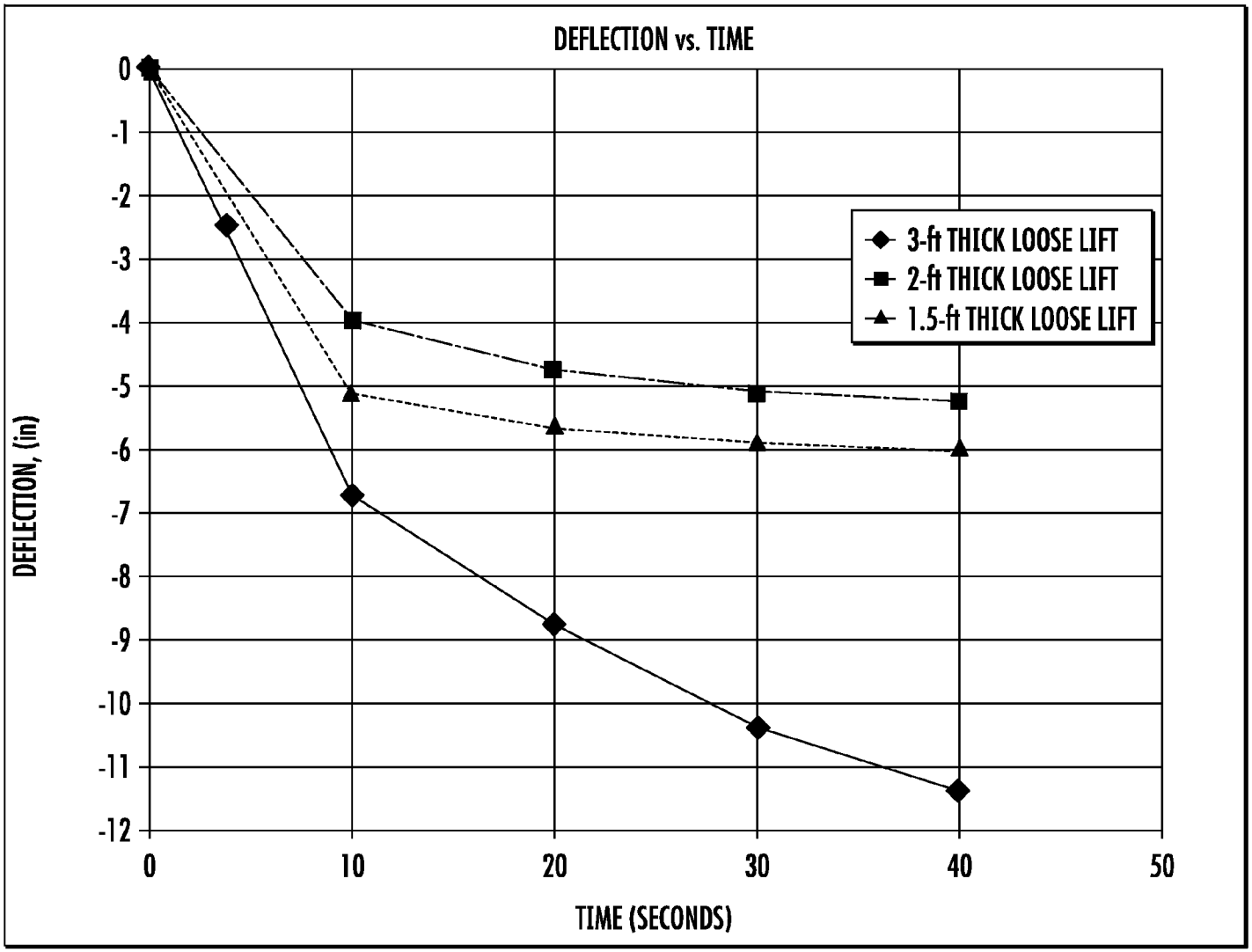
FIG. 7 illustrates deflection versus time on columns installed as in Example II.

A series of tests were performed to measure deflection versus tamping time for 1.5, 2.0, and 3.0 foot thick loose lift thicknesses. A plot showing results is illustrated in FIG. 7. The plot indicates that larger deflections are noted during tamping of 3-foot thick lifts than for 1.5 or 2-foot thick lifts. The tamping deflection results for the 1.5 and 2-foot thick lift columns follow essentially the same trajectory after the first time increment. Incremental deflections as observed after 10 seconds of tamping of tamping are essentially the same for both columns.

Figure 8:
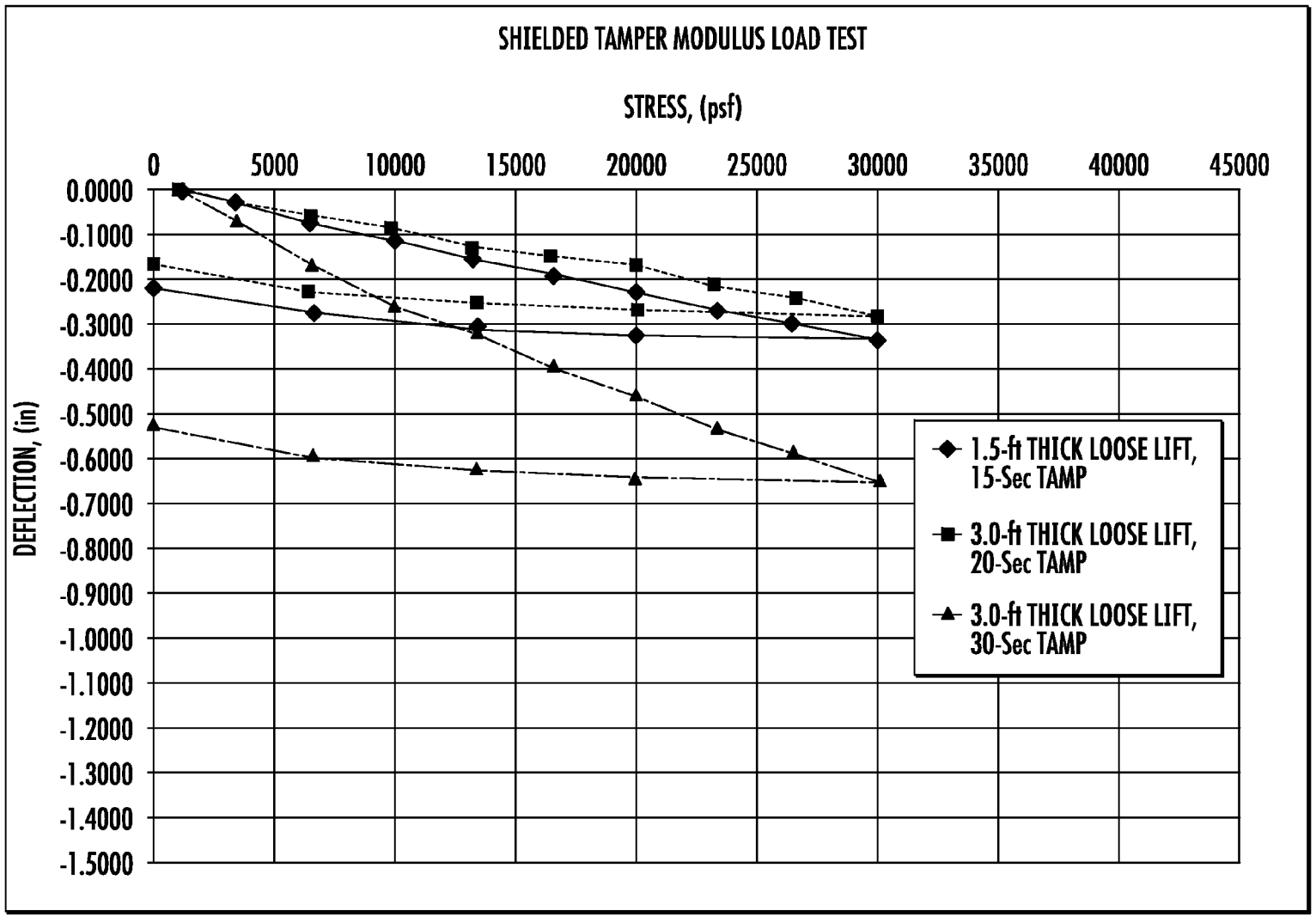
FIG. 8 illustrates the results of three modulus tests on columns installed as in Example II.

A composite plot of the three modulus tests is illustrated in FIG. 8. The results indicate that the modulus response of the 1.5 foot loose lift column is essentially the same as the 3-foot loose lift column compacted to 20 seconds per lift. Slightly lower modulus values are shown for the 3-foot loose lift column compacted to 30 seconds per lift.

EXAMPLE III

As an additional example, the system including the tamper device 11 of the invention was used to install columns at a Tower Tech Systems site in Brandon, S.Dak. Test columns were located 12 and 24 feet south of the southernmost standard-constructed test column. The goal of this particular test was to make a direct comparison of the tamper device 11 of the present invention to a standard installed column using a conventional tool such as shown in U.S. Pat. No. 5,249,892.

The soil conditions at the site consisted of soft clay extending to 15.5 feet underlain by sand. SPT N-values in the clay within the reinforced zone ranged from 2 to 4 bpf. Moisture content ranged from 22 to 36%. Groundwater was located at a depth of about 9 feet.

Both 30-inch diameter standard columns and 20-inch diameter columns using an 18-inch diameter shielded tamper head were installed for testing at the site. The conventional 30-inch diameter test columns were extended to depths of 16 and 17.5 feet, and the 20-inch diameter test columns installed with the shielded tamper head were extended to a depth of 14 feet.

The equipment according to the invention consisted of a 5-foot long, 18-inch diameter cylinder shield 17 fitted with a beveled tamper head 15 attached to a long shaft 13 and the hydraulic hammer 31. The northern test hole built according to the invention was typically backfilled in 3-foot loose lifts with 30 seconds of tamping time per lift, whereas the southern test hole built according to the invention was typically constructed with 5-foot loose lifts with 45 seconds of tamping time. Crushed quartzite was used to construct the columns.

The tables below include the initial depth, the depth to the top of the next loose lift, and then the depth to the top of the compacted lift, all in feet. The final numbers include loose lift thickness and the amount of compaction per lift.

TABLE 1

Northern Test Column of the invention installation details (30 seconds tamping/lift)

| Bottom of Hole Depth (ft) | Top of Loose Lift Depth (ft) | Top of Compacted Lift (ft) | Loose Lift Thickness (ft) | Compaction Achieved (ft) | Compacted Lift Thickness (in) |
|---|---|---|---|---|---|
| 14.0 | 11.0 | 12.7 | 3.0 | 1.7 | 1.3 |
| 12.7 | 9.7 | 11.8 | 3.0 | 2.1 | 0.9 |
| 11.8 | 8.8 | 10.0 | 3.0 | 1.2 | 1.8 |
| 10.0 | 7.0 | 8.0 | 3.0 | 1.0 | 2.0 |
| 8.0 | 5.0 | 5.7 | 3.0 | 0.7 | 2.3 |
| 5.7 | 2.7 | 4.0 | 3.0 | 1.3 | 1.7 |
| 4.0 | 1.0 | 2.25 | 3.0 | 1.25 | 1.75 |

From Table 1, it can be seen that there was considerable variability in the compaction achieved from each of the 3-foot loose lifts. The bottom lift was constructed of the larger rock used on site, about 3-inches in maximum diameter. Even so, during compaction of the first lift, the bottom plate rotated significantly due to the soft bottom, so the tell-tale readings may not be meaningful from the modulus test. An 18-inch diameter column cap was installed. The top of column was maintained about 2 feet below the adjacent ground surface to allow for the concrete column cap.

A BST on the second lift yielded 2 inches of deflection. A BST on the third lift yielded 1⅛ inch deflection. No further BSTs were performed in an effort to maintain a tamping time of 30 seconds.

TABLE 2

Southern Test Column according to the invention installation details (45 seconds tamping/lift)

| Bottom of Hole Depth (ft) | Top of Loose Lift Depth (ft) | Top of Compacted Lift (ft) | Loose Lift Thickness (ft) | Compaction Achieved (ft) | Compacted Lift Thickness (in) |
|---|---|---|---|---|---|
| 14.0 | 9.0 | 10.5 | 5.0 | 1.5 | 3.5 |
| 10.5 | 5.5 | 7.0 | 5.0 | 1.5 | 3.5 |
| 7.0 | 2.0 | 3.25 | 5.0 | 1.25 | 3.75 |
| 3.25 | 1.0 | 1.5 | 2.25 | 0.5 | 1.75 |

From Table 2, it can be seen that the compaction achieved from each of the 5-foot loose lifts was relatively constant at about 1.25 to 1.5 feet. The bottom lift was constructed of 2 feet of the larger rock used on site, about 3-inches in maximum diameter, and then 3 feet of the smaller rock, about 1-inch in maximum particle diameter. The top of column was maintained 1.5 feet below the adjacent ground surface to allow for the concrete column cap. An 18-inch diameter column cap was installed.

Figure 9:
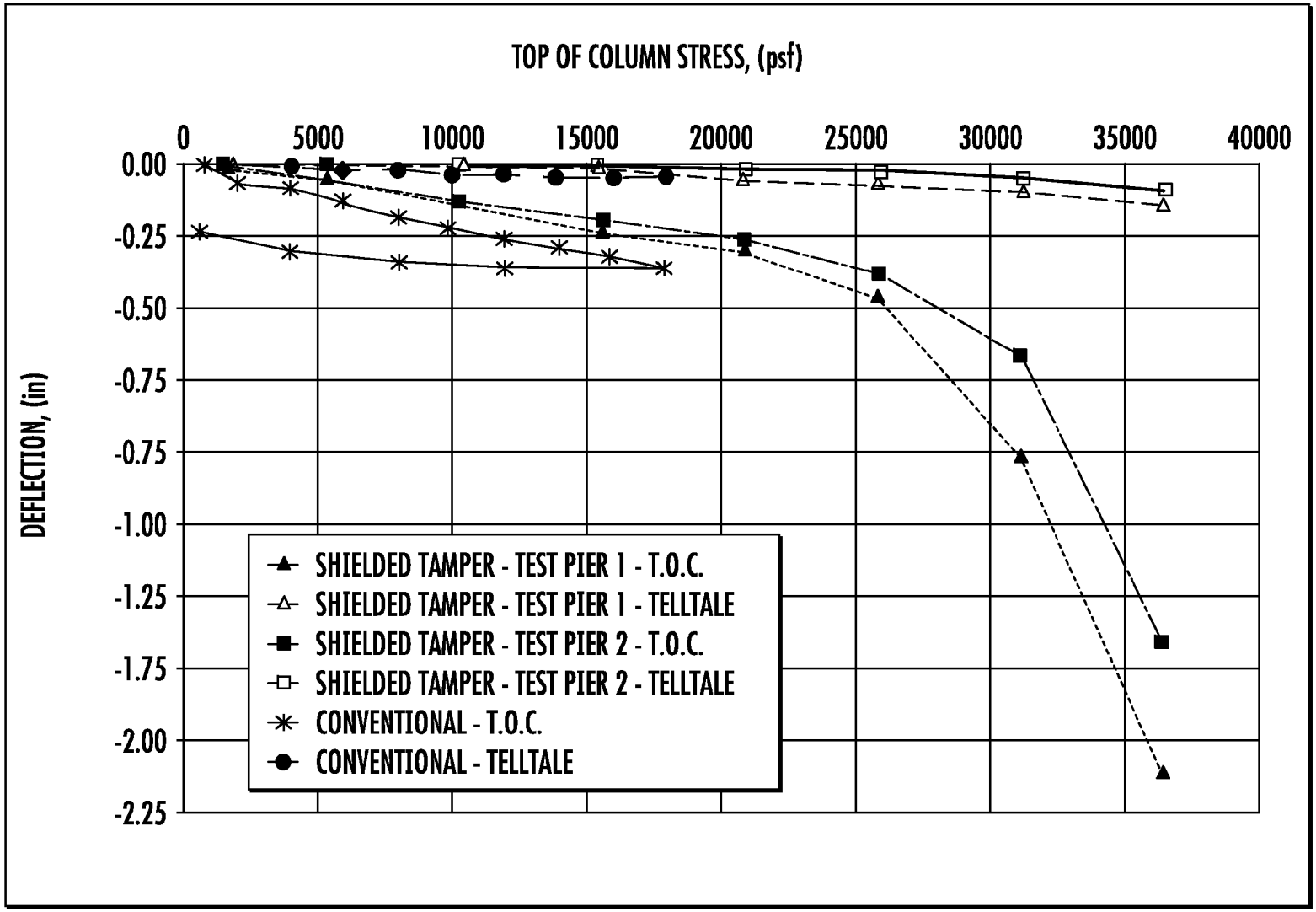
FIG. 9 illustrates the results of stress tests on columns installed as in Example III.

The columns of the invention were compared to a 30-inch diameter standard-conventional column element installed with typical 12-inch thick compacted lifts. The results of the modulus tests are shown in FIG. 9 on a stress basis. The top-of-column stress for columns according to the invention was calculated based on an 18-inch diameter concrete cap.

The test results indicate that the columns installed with the shielded tamper of the present invention and loose lift thicknesses of both 3 and 5-feet exhibited a slightly higher stiffness at similar stress levels to the 30-inch diameter column installed conventionally. At high stress levels, the column installed with the invention exhibited a break in the curve similar to a conventional response. This suggests that the compaction of the column was sufficient to achieve a dilatent response at stress levels less than about 30,000 psf.

The foregoing detailed description of embodiments refers to the accompanying drawings, which illustrate specific embodiments of the invention. Other embodiments having different structures and operations do not depart from the scope of the invention. The term "the invention" or the like is used with reference to certain specific examples of the many alternative aspects or embodiments of the applicant's invention set forth in this specification, and neither its use nor its absence is intended to limit the scope of the applicant's invention or the scope of the claims. This specification is divided into sections for the convenience of the reader only. Headings should not be construed as limiting of the scope of the invention. The definitions are intended as a part of the description of the invention. It will be understood that various details of the invention may be changed without departing from the scope of the invention. Furthermore, the foregoing description is for the purpose of illustration only, and not for the purpose of limitation.

What is claimed is:

1. A tamper device in combination with a preformed generally cylindrical elongate cavity, the device comprising:

a) a shaft for driving a tamper head;

b) a tamper head attached at the end of the shaft for tamping a lift of aggregate in the generally cylindrical elongate cavity formed in a ground surface, said tamper head having a generally flat, blunt bottom face; and c) a shield extending upwardly a predetermined height from said tamper head an amount sufficient to prevent sidewalls of a cavity in soft soil in which the tamper device is used from failing and collapsing into the cavity.

2. The tamper device of claim 1, wherein said tamper head further comprises a tapered surface extending circumferentially from said bottom face to an edge thereof.

3. The tamper device of claim 2, wherein said tapered surface extends upwardly from the blunt bottom face at an angle of about 45 degrees.

4. The tamper device of claim 1, wherein said shield is of a width wherein it is in abutment at a bottom edge thereof with the tamper head at a top surface about an edge thereof.

5. The tamper device of claim 4, wherein said shield rests on the tamper head and has an opening for allowing passage of said shaft having said tamper head attached thereto.

6. The tamper device of claim 1, wherein said predetermined height of said shield is in the range of about 3 to 5 feet.

7. The tamper device of claim 6, wherein said width of the tamper head is in the range of about 12 to 36 inches.

8. The tamper device of claim 7, wherein said tamper head is shaped substantially circular.

9. The tamper device of claim 8, wherein said tamper head has a generally flat, blunt bottom face and a tapered surface extending from said bottom face to an edge thereof.

10. The tamper device of claim 1, wherein said shield comprises a hollow cylinder.

11. The tamper device of claim 10, wherein said hollow cylinder is filled with lightweight foam.

12. The tamper device of claim 1, wherein said shield comprises synthetic belting wrapped around the shaft.

13. A method of constructing aggregate columns, comprising the steps of:

a) preforming an elongate cavity in a ground surface, said cavity having a generally uniform cross-sectional area;

b) placing a lift of aggregate into the cavity; and c) tamping the lift with a tamper device having a tamper head attached at the end of a shaft, said tamper head having a generally flat, blunt bottom face, and having a shield extending upwardly a predetermined height from said tamper head an amount sufficient to prevent sidewalls of the cavity from failing and collapsing into the cavity.

14. The method of claim 13, wherein said tamper head further comprises a tapered surface extending circumferentially from said bottom face to an edge thereof.

15. The method of claim 14, wherein said tapered surface extends upwardly from the blunt bottom face at an angle of about 45 degrees.

16. The method of claim 13, wherein said shield is of a width wherein it is in abutment at a bottom edge thereof with the tamper head at a top surface about an edge thereof.

17. The method of claim 16, wherein said shield rests on the tamper head and has an opening for allowing passage of said shaft having said tamper head attached thereto.

18. The method of claim 13, wherein said tamping is conducted by driving the tamper head with said shaft extending upwardly therefrom, said shield extending upwardly a predetermined height sufficient to prevent said side walls of the elongate cavity from failing and collapsing into the cavity during tamping operations, and said shield having an opening at the top allowing said shaft to pass therethrough to connect to said tamper head.

19. The method of claim 13, wherein said predetermined height of said shield is in the range of about 3 to 5 feet.

20. The method of claim 19, wherein said width of the tamper head is in the range of about 12 to 36 inches.

21. The method of claim 20, wherein said tamper head is shaped substantially circular.

22. The method of claim 13 wherein the thickness of the lift of aggregate is approximately equal to two to three times the distance across the cavity.

23. The method of claim 13, wherein said tamping is conducted in a cavity formed in soft soil.

24. The method of claim 13, wherein said shield comprises a hollow cylinder.

25. The method of claim 24, wherein said hollow cylinder is filled with lightweight foam.

26. The method of claim 13, wherein said shield comprises synthetic belting wrapped around the shaft.

* * * * *